US009759526B2

(12) United States Patent
Wemhoener et al.

(10) Patent No.: US 9,759,526 B2
(45) **Date of Patent: *Sep. 12, 2017**

(54) ANTI-BALLISTIC CHAIR

(71) Applicant: SHIELDPRO, LLC, Irvine, CA (US)

(72) Inventors: Jens Wemhoener, Aachen (DE); Peter Mowbray, Tustin, CA (US); Fred Peters, Orange, CA (US)

(73) Assignee: ShieldPro, LLC, Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/092,550

(22) Filed: Apr. 6, 2016

(65) Prior Publication Data

US 2016/0216079 A1 Jul. 28, 2016

Related U.S. Application Data

(63) Continuation of application No. 14/554,846, filed on Nov. 26, 2014, now Pat. No. 9,335,128.

(Continued)

(51) Int. Cl.

| | |
|---|---|
| ***A47C 13/00*** | (2006.01) |
| ***A47C 7/62*** | (2006.01) |
| ***A47C 7/50*** | (2006.01) |
| ***F41H 5/00*** | (2006.01) |
| ***F41H 5/06*** | (2006.01) |
| ***F41H 5/08*** | (2006.01) |

(Continued)

(52) U.S. Cl.

CPC ..... *F41H 5/08* (2013.01); *A47C 1/00* (2013.01); *A47C 5/00* (2013.01); *A47C 7/62* (2013.01); *F41H 5/013* (2013.01); *F41H 5/0471* (2013.01)

(58) Field of Classification Search

CPC ..... F41H 5/0471; F41H 5/08; F41H 5/013; A47C 5/00

USPC ..... 297/105, 108, 109, 111, 233, 234, 235, 297/423.13, 188.04, 188.08; 89/36.01, 89/36.02, 36.03, 36.04, 36.05, 36.06, 89/36.07, 917, 918

See application file for complete search history.

(56) References Cited

U.S. PATENT DOCUMENTS 116,384 A * 6/1871 Wilson ..... A47C 1/126 297/108

265,190 A * 9/1882 Van Winkle ..... A47D 11/005 297/105

(Continued)

FOREIGN PATENT DOCUMENTS

DE 10310088 A1 4/2004

OTHER PUBLICATIONS

International Search Report and Written Opinion for PCT/US2014/067705, dated Mar. 13, 2015, 11 pages.

(Continued)

*Primary Examiner* — Rodney B White

(74) *Attorney, Agent, or Firm* — Procopio; Noel Gillespie; Michael Jones

(57) ABSTRACT

An Anti-Ballistic chair having a back portion, a seat portion, and an Anti-Ballistic panel within at least one of the back portion, and the seat portion, wherein the Anti-Ballistic portion comprises at least a first layer of Anti-Ballistic material formed from high-strength synthetic fibers extending in a first direction, and at least a second layer of Anti-Ballistic material formed from high-strength synthetic fibers extending in a second direction, different from the first direction.

20 Claims, 5 Drawing Sheets

Related U.S. Application Data

(60) Provisional application No. 61/909,911, filed on Nov. 27, 2013.

(51) Int. Cl.

| | |
|---|---|
| ***F41H 5/04*** | (2006.01) |
| ***F41H 5/013*** | (2006.01) |
| ***A47C 5/00*** | (2006.01) |
| ***A47C 1/00*** | (2006.01) |

(56) References Cited

U.S. PATENT DOCUMENTS 533,032 A * 1/1895 Breed ..... A47C 7/024 297/107
2,122,935 A * 7/1938 Fleischer ..... A47C 3/023 297/411.4
2,146,932 A * 2/1939 Boman ..... A47C 3/045 297/239
2,600,759 A * 6/1952 Gross ..... A47C 16/025 248/166
2,671,228 A * 3/1954 De Maria ..... A47C 17/16 297/188.11
2,874,755 A * 2/1959 Smith ..... A47C 3/04 108/91
3,107,119 A * 10/1963 Watts ..... A47B 85/04 297/128
4,043,529 A * 8/1977 Pickles ..... B60N 2/169 248/419
4,209,158 A * 6/1980 Pickles ..... B60N 2/1615 248/421
4,470,632 A * 9/1984 Babbs ..... B60N 2/0232 297/330
4,682,813 A * 7/1987 Fohr ..... A01K 97/06 108/151
4,715,652 A * 12/1987 Ward ..... A47C 1/16 297/188.11
4,765,582 A * 8/1988 Babbs ..... B60N 2/0232 248/394
4,971,390 A * 11/1990 McGinley ..... A47C 7/62 297/188.11
5,014,958 A * 5/1991 Harney ..... B60N 2/0224 248/394
5,096,249 A * 3/1992 Hines ..... B60R 7/043 224/275
5,109,963 A * 5/1992 Husted ..... B60N 2/161 192/80
5,180,880 A * 1/1993 Zufle ..... B32B 7/02 428/113
5,441,331 A * 8/1995 Vento ..... B60N 2/10 297/452.14
5,448,938 A * 9/1995 Fernandez ..... B60N 2/6009 109/49.5
5,582,463 A * 12/1996 Linder ..... B60N 2/72 297/218.5
5,647,632 A * 7/1997 Fireman ..... A47C 13/00 297/109
5,653,507 A * 8/1997 Moore ..... A47C 1/124 297/188.08
5,797,574 A * 8/1998 Brooks ..... B60N 2/0232 248/398
5,997,080 A * 12/1999 Newhouse ..... A47C 1/022 297/188.08
6,170,379 B1 * 1/2001 Taylor ..... F41H 5/08 312/196
6,179,382 B1 * 1/2001 Schwartz ..... A47C 5/02 297/239
6,196,632 B1 * 3/2001 De Lucchi ..... A47C 3/026 297/301.1
6,273,507 B1 * 8/2001 Downey ..... B60N 2/0224 248/419
6,286,901 B1 * 9/2001 Ritch ..... A47C 3/04 297/239
6,309,019 B1 * 10/2001 Downey ..... B60N 2/0224 248/421
6,688,554 B2 * 2/2004 Weekly ..... B64D 11/06 244/118.5
6,786,126 B2 * 9/2004 Sargent ..... F41H 5/0485 2/2.5
6,793,232 B1 * 9/2004 Wing ..... A61G 5/006 280/304.1
6,811,225 B1 * 11/2004 Konya ..... A47C 9/005 297/321
7,147,286 B2 * 12/2006 Cesaroni ..... A47C 3/045 297/239
7,148,162 B2 * 12/2006 Park ..... F41H 5/0471 2/2.5
7,552,975 B2 * 6/2009 Maier ..... A47C 3/023 297/440.16
7,669,935 B2 * 3/2010 Crossley ..... A47C 3/12 297/411.2
7,946,972 B2 * 5/2011 Guissin ..... A47C 1/023 297/284.11
7,963,605 B2 * 6/2011 Ramaseshadri ..... B60N 2/002 297/344.12
7,988,237 B2 8/2011 Peters
8,052,112 B2 * 11/2011 Lawall ..... B60N 2/0224 248/429
8,465,091 B2 * 6/2013 Su ..... A47C 13/00 297/108
8,573,704 B2 * 11/2013 Peters ..... A47C 3/04 297/239
8,579,367 B2 11/2013 Peters et al.
9,010,230 B2 * 4/2015 Peters ..... F41H 5/24 112/475.17
9,010,231 B1 * 4/2015 Cohn ..... F41H 5/08 89/36.07
9,335,128 B2 * 5/2016 Wemhoener ..... A47C 1/00
2002/0140278 A1 * 10/2002 Hlavaty ..... B60R 22/4619 297/464
2003/0102701 A1 * 6/2003 Pedronno ..... B60N 2/42745 297/216.1
2004/0066082 A1 * 4/2004 Mears ..... A47C 5/00 297/452.12
2005/0225131 A1 * 10/2005 Hynes ..... A47C 7/62 297/188.11
2005/0257678 A1 * 11/2005 Camp ..... F41C 33/06 89/36.07
2005/0275267 A1 * 12/2005 Schumann ..... B60N 2/1685 297/344.12
2007/0108807 A1 * 5/2007 Crossley ..... A47C 3/12 297/184.1
2008/0224519 A1 * 9/2008 Ventura ..... B60N 2/06 297/313
2009/0058158 A1 * 3/2009 Sobieski ..... B60N 2/0296 297/338
2009/0236884 A1 * 9/2009 Lawall ..... B60N 2/22 297/217.3
2010/0013285 A1 * 1/2010 Stanz ..... B60N 2/0232 297/344.13
2010/0107861 A1 * 5/2010 Carter ..... B60N 2/60 89/36.02
2010/0171349 A1 * 7/2010 Dellanno ..... F41H 7/046 297/216.12
2010/0327639 A1 * 12/2010 Peters ..... A47C 7/00 297/183.1
2012/0152096 A1 * 6/2012 Peters ..... F41H 5/06 89/36.01
2012/0247313 A1 * 10/2012 Peters ..... A47C 3/04 89/36.02
2012/0306252 A1 * 12/2012 Ligonniere ..... B64D 11/06 297/354.1
2013/0099539 A1 * 4/2013 Fienup ..... A61B 3/024 297/325
2014/0084646 A1 * 3/2014 Benden ..... F41H 5/08 297/217.1
2014/0174284 A1 * 6/2014 Peters ..... F41H 5/24 89/36.02

(56) References Cited

U.S. PATENT DOCUMENTS

OTHER PUBLICATIONS

European Extended Search Report for EP Application 14865927.9, dated Jun. 29, 2017, 8 pages.

* cited by examiner

ANTI-BALLISTIC CHAIR

CROSS-REFERENCE TO RELATED APPLICATIONS

This application is a continuation of U.S. patent application Ser. No. 14/554,846, filed on Nov. 26, 2014, now U.S. Pat. No. 9,335,128, issued on May 10, 2016, which claims benefit of priority from Provisional U.S. Patent application Ser. No. 61/909,911, filed Nov. 27, 2013, the contents of which are incorporated by reference.

FIELD OF THE INVENTION

This application relates to a construction of Chairs, more particularly chairs having portions with Anti-Ballistic properties.

BACKGROUND

Bulletproofing is the process of making something capable of stopping a bullet or similar high velocity projectiles e.g. shrapnel. The term bullet resistance is often preferred because few, if any, practical materials provide complete protection against all types of bullets, or multiple hits in the same location. Bullet designs vary widely, not only according to the particular firearm used (e.g. a 9×19 mm Parabellum caliber hollow point handgun cartridge will have inferior penetration power compared to a 7.62×39 mm assault rifle cartridge), but also within individual cartridge designs. As a result, while some so-called "bullet-proof" panels may successfully prevent penetration by standard 7.62×39 mm bullets containing lead cores, the same panels may easily be defeated by 7.62×39 mm armor piercing bullets containing hardened steel penetrators.

Bullet-resistant materials, also called ballistic materials or, equivalently, Anti-Ballistic materials, are usually rigid, but may be supple. They may be complex, such as KEVLAR® LEXAN®, and carbon fiber composite materials, or they may be basic and simple, such as steel or titanium. Bullet resistant materials are often used in law enforcement and military applications, to protect personnel from death or serious injuries.

There is a growing need for methods of self-protection in an increasingly wide variety of locations. In the modern world, crimes and attacks committed by persons with guns are an ever more common occurrence. In the past, police personnel and military personnel have been the primary targets of gunfire which has been directed toward them during work or duty. Because of this continual risk of harm, bullet resistant vests and shields have been developed which may be deployed or worn on the user's body as a protective component of their work attire. Such devices, when employed for protection against weapons fire have worked fairly well in preventing a high velocity bullet or shell from penetrating the wearer's body since the velocity is slowed considerably.

It has been made evident by recent shootings, such as Fort Hood, there may be a need for additional means of self-protection. This mass shooting took place on Nov. 5, 2009, at Fort Hood, the most populous U.S. military installation in the world, located just outside Killeen, Tex. In the course of the shooting, a single gunman killed 13 people and wounded 29 others. According to witnesses, some individuals attempted to stop the shooter, either by charging him or throwing a chair at him, but were mortally wounded in the process.

It was additionally made evident at Columbine High School in Colorado in 1999 that similar occurrences may also occur in other locations where civilians, including children may be affected and there is an increased need for self-protection. If an Anti-Ballistic chair which can blend into a conventional room's appearance where people gather such as meeting rooms, classrooms, libraries or cafeterias and avoid rooms where people gather for social or educational purposes taking on the appearance of military bunkers.

New materials and improvements of manufacturing processes may allow items such ballistic-proof chairs to become a practical item. Previously, bullet-proof vests have been constructed by applying multiple layers of fabric woven from an aramid fiber together, which is sold by Du Pont under the Trademark KEVLAR. It can be used in a flexible state or laminated in a more rigid configuration. The success of the product is attained by multiple layers of the semi-impregnable flexible structure. This material combines high penetration resistance with lightness and flexibility but no one has endeavored to manufacture items like chairs using this material.

As should be understood that embodiments of the present application are not limited to the details of construction and to the arrangement of the components or the steps set forth in the following description or illustrated in the drawings. The various alternatives or combinations of the features shown or described herein may be incorporated into other embodiments and practiced and carried out in various ways, which might be apparent to those skilled in the an once the information herein is reviewed. Also, it is to be understood that the phraseology and terminology employed herein are for the purpose of description, and should not be regarded as limiting in any fashion. As such, those skilled in the art will appreciate that the conception upon which this disclosure is based may readily be utilized as a basis for designing other furniture type ballistic shields for carrying out the several purposes of the present disclosed device and method. It is important, therefore, that the embodiments, objects and claims herein, be regarded as including such equivalent construction and methodology insofar as they do not depart from the spirit and scope of the present invention.

SUMMARY

One aspect of an implementation of the present application may include a high-back chair having an internal core formed with at least one Anti-Ballistic panel. The Anti-Ballistic panel may be formed from at least a first layer having high strength synthetic fibers extending in a first direction and a second layer having high strength synthetic fibers extending in a second direction, different from the first direction. The at least one Anti-Ballistic panel may positioned within a back portion of the chair.

In another aspect of an implementation, the at least the first layer and the at least a second layer may each be formed from a sheet of Anti-Ballistic fabric.

In another aspect of an implementation of the present application, the Anti-Ballistic panel may include a frame and the at least a first layer may be formed by wrapping the high strength synthetic fibers around the frame in the first direction, and the at least a second layer may be formed by wrapping the high strength synthetic fibers around the frame in the second direction.

In another aspect of an implementation of the present application the Anti-Ballistic panels may be integrated into internal core of the chair. In such an implementation, the Anti-Ballistic panel may be formed by wrapping high-strength synthetic fibers around an internal frame of the chair in two different directions.

In another aspect of an implementation of the present application the Anti-Ballistic panels may be formed to be separate from the internal core of the chair. In such an implementation, a pocket or pouch may be provided proximate to the internal core of the chair and the Anti-Ballistic panel may be inserted into the pocket or pouch and held substantially parallel to the internal core.

In another aspect of an implementation of the present application, the chair may also include a compartment within which to store a firearm. The compartment may be disposed on a bottom surface of the seat portion of the chair.

In another aspect of an implementation of the present application, the compartment may include a locking mechanism configured secure the compartment and prevent unauthorized access. For example, the locking mechanism may include a push button lock requiring a specific key sequence, or a biometric lock requiring specific biometric information to allow access.

In another aspect of an implementation of the present application, a skirt may be provided to extend downward from the seat portion of the chair.

In another aspect of an implantation of the present application, the skirt may be hinged to fold up onto the seat portion of the chair.

In another aspect of an implementation of the present application, additional Anti-Ballistic panels may also be positioned in the seat portion or a skirt portion formed on the front, lower portion of the chair.

Additionally, the Anti-Ballistic core portions of the Anti-Ballistic Chairs may be fabricated using not only Aramid fibers and KEVLAR® from DuPont, but also polyethylene fibers and GOLD SHIELD®, which is a KEVLAR® based material, and SPECTRA SHIELD®, which is polyethylene based material, both available commercially from Honeywell. GOLD SHIELD® and SPECTRA SHIELD® are high strength synthetic fibers impregnated in partially cured resin for use in ballistic material.

Moreover, both of the Honeywell materials can be used as layered soft armor as well as hard armor when they are autoclaved or compression molded into Anti-Ballistic components for construction of the Anti-Ballistic Chairs. Other similar materials of like purpose and function are also anticipated by this disclosure.

Other aspects of implementations of the present application may be discussed or may become apparent in view of the following description of embodiments of the present application and the figures enclosed with this application. In this respect, it is to be understood that the design is not limited in its application to the details of construction and to the arrangement of the components set forth in the following description or illustrated in the drawings. In addition, it is to be understood that the phraseology and terminology employed herein are for the purpose of description and should not be regarded as limiting.

While the description of the Anti-Ballistic Chairs has been made herein with reference to particular embodiments thereof, a latitude of modifications, various changes and substitutions are intended in the foregoing disclosure, and it will be appreciated that in some instance some features of the design will be employed without a corresponding use of other features without departing from the scope of the invention as set forth.

BRIEF DESCRIPTION OF THE DRAWINGS

The accompanying drawings, which are incorporated in and form a part of this specification, illustrate embodiments of the Anti-Ballistic Chairs and together with the description, serve to explain the aspects of this application.

For a fuller understanding of the nature of the Anti-Ballistic Chairs, reference should be made to the following detailed description taken in conjunction with the accompanying drawings which are incorporated in and from a part of this specification, illustrate embodiments of the design and together with the description, serve to explain the principles of this application.

DETAILED DESCRIPTION OF EMBODIMENTS

Figure 1:
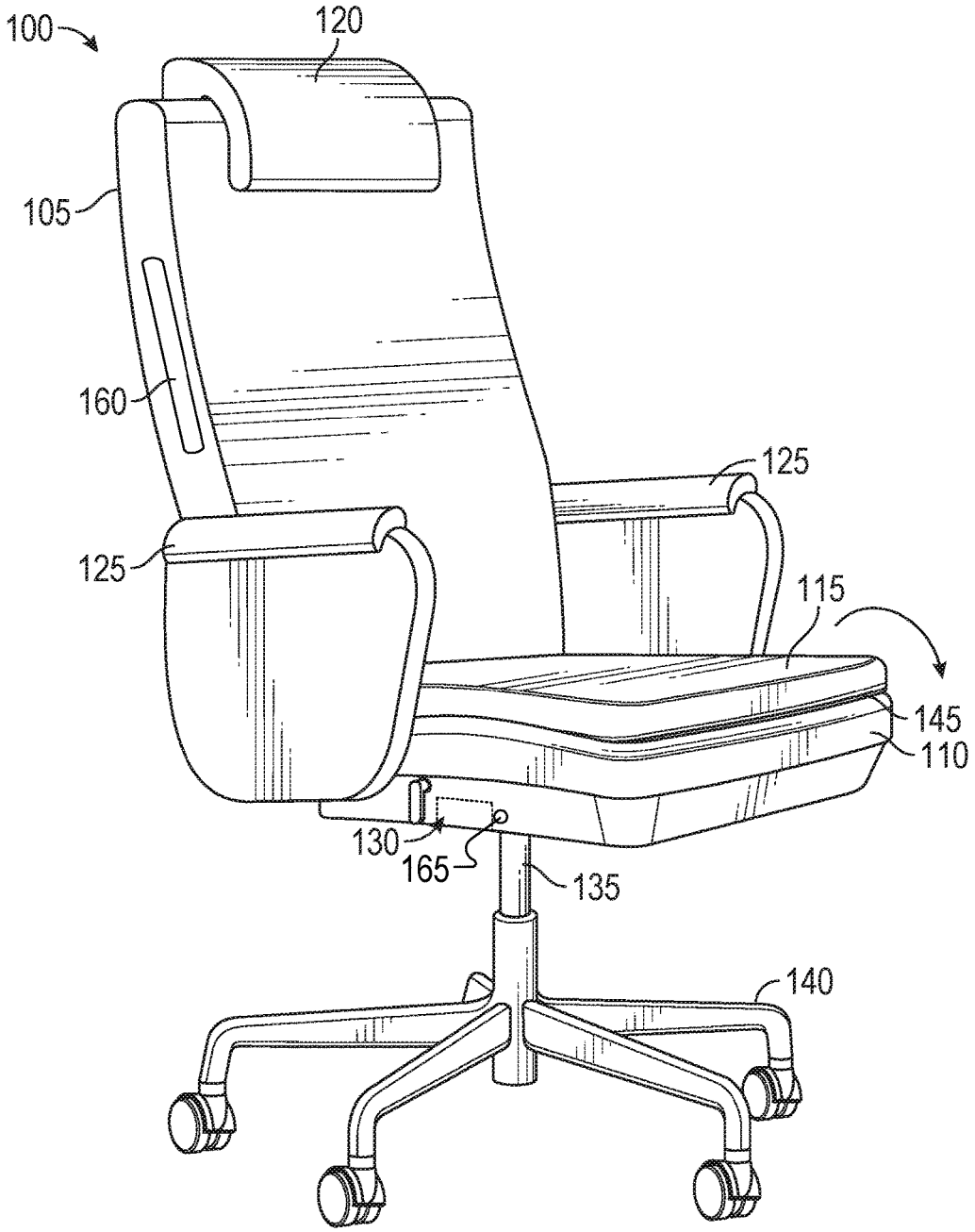
FIG. 1 depicts a first perspective view of an Anti-Ballistic Chair constructed in accordance with an embodiment of the present application.
Figure 2:
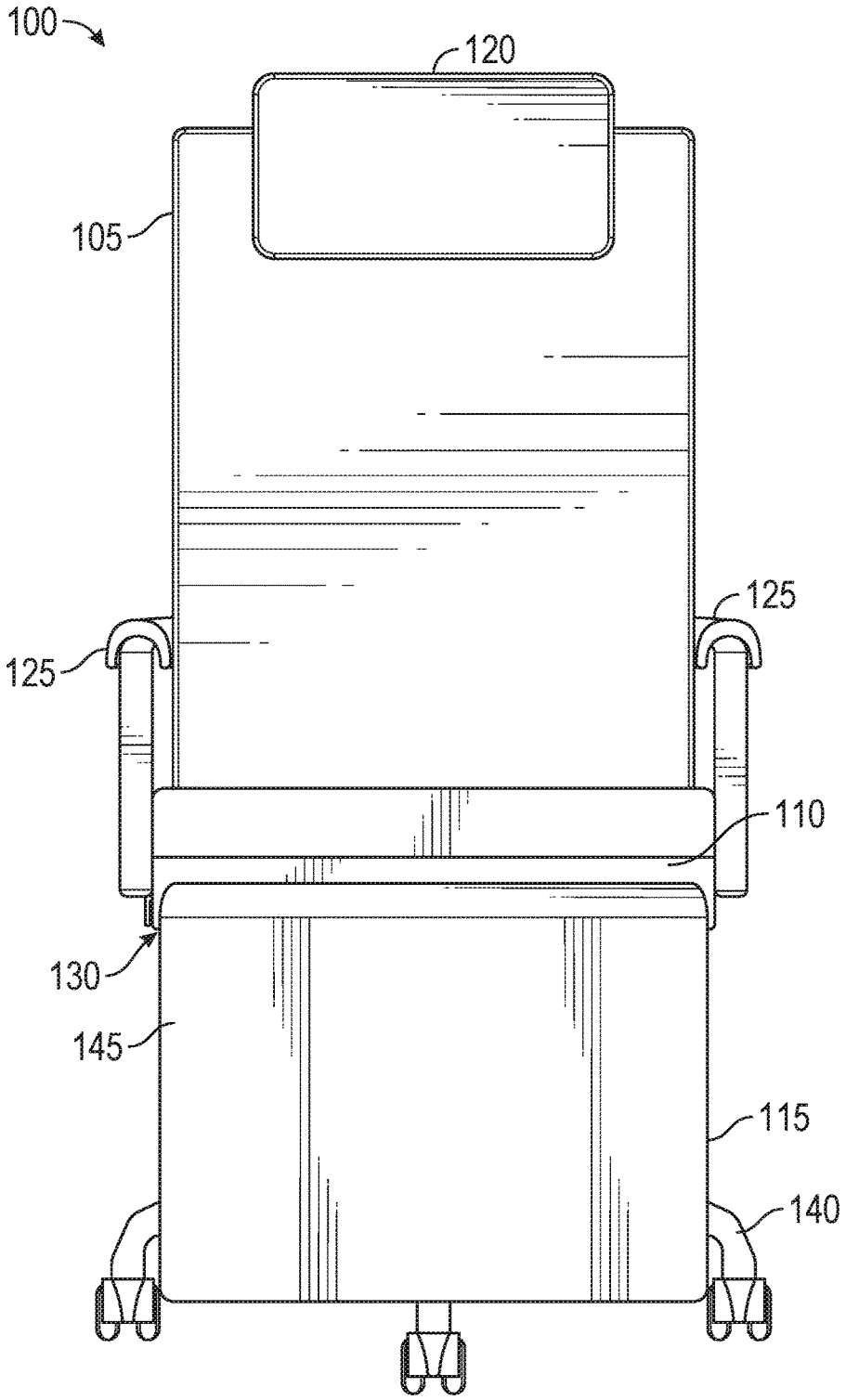
FIG. 2 depicts a front view of the Anti-Ballistic Chair constructed in accordance with the embodiment of the present application.
Figure 3:
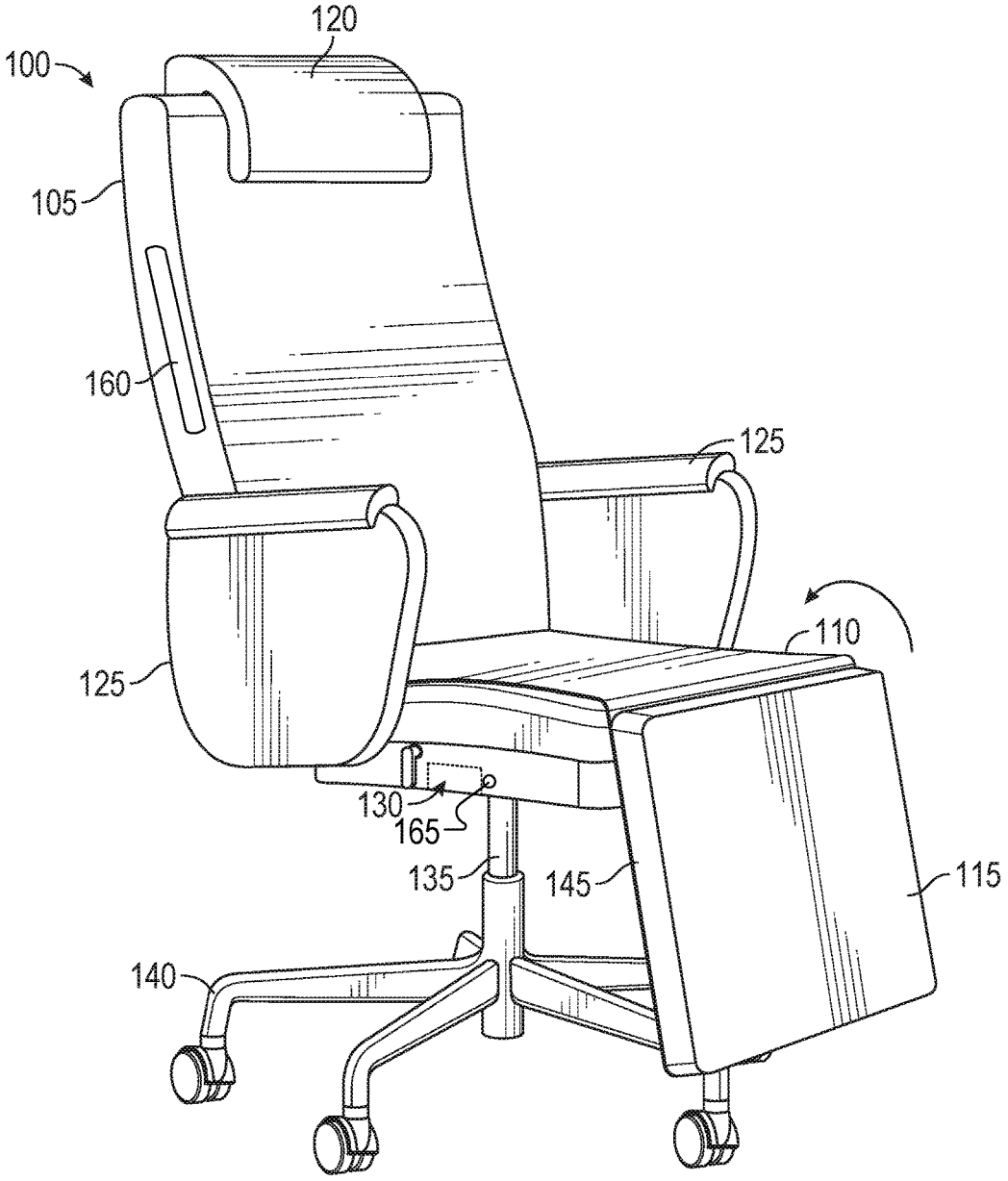
FIG. 3 depicts a second perspective view of an Anti-Ballistic Chair constructed in accordance with an embodiment of the present application.

FIG. 1 depicts a first perspective view of an Anti-Ballistic Chair 100 constructed in accordance with an embodiment of the present application. Further, FIG. 2 depicts a front view of the Anti-Ballistic Chair 100 constructed in accordance with the embodiment of the present application. FIG. 3 depicts a second perspective view of an Anti-Ballistic Chair 100 constructed in accordance with an embodiment of the present application.

As illustrated, the Anti-Ballistic chair 100 is a high back executive swivel chair as may be found in many offices and government agencies. The Anti-Ballistic chair 100 shown includes a back portion 105, a seat portion 110, and a front skirt 115 extending downward from the seat portion 110. The Anti-Ballistic chair may also include a head rest 120 positioned at an upper part of the back portion 105 and a pair of arm rests 125, each located on one side of the seat portion 110. The Anti-Ballistic chair illustrated also includes a storage compartment 130 disposed beneath the seat member 110 that can be accessed by a user of the chair. The Anti-Ballistic chair may also include a low friction swivel mechanism to allow the chair to be rotated quickly in response to a recognized danger and a wheel assembly 140 allowing the chair to be rolled across a floor surface.

As illustrated in FIGS. 1-3, the back portion 105 and the seat portion 110 are positioned at angles to one another to provide a sitting area for a user. Additionally, in this embodiment, the front skirt 115 is connected to the seat portion 110 by a hinged portion 145 that allows the skirt portion 115 to be folded up to sit parallel to the seat portion 110 (as shown in FIG. 1) and be folded down (as shown in FIG. 2 and FIG. 3) to sit behind and provide shielding to the user's legs.

Additionally, in some embodiments, the skirt portion 115 may also include a locking mechanism configured to hold the skirt portion 115 in the folded down position. The locking mechanism may prevent the skirt portion 115 from moving upward and potentially injuring a user of the chair 100 when struck by a bullet. By providing a locking mechanism to hold the skirt portion 115 in the folded down position, a ballistic trajectory of an incoming bullet may be better stopped or deflected.

In the above discussed embodiments, a skirt portion is provided. However, embodiments of the present application need not have a skirt portion and embodiments of the present application are not required to have a skirt portion.

As discussed in greater detail below with respect to FIGS. 4-7, at least one of the back portion 105, seat portion 110, and skirt portion 115 may be formed with an Anti-Ballistic panel incorporated therein. In some embodiments, the Anti-Ballistic panel may be incorporated into the core of any one of the back portion 105, seat portion 110, and skirt portion 115. For example, the back portion 105 may be formed with an internal frame and the Anti-Ballistic panel may be formed by wrapping high strength synthetic fibers such as aramid around the frame in at least two different directions. Additionally, as discussed in greater detail below, padding may be provided between the Anti-Ballistic panel and a covering surrounding back panel 105.

Further, the seat portion 110 may also be formed with an internal frame and the Anti-Ballistic panel may be formed by wrapping high strength synthetic fibers such as aramid around the frame in at least two different directions. Additionally, padding may be provided between the Anti-Ballistic panel and a covering surrounding seat panel 110.

Further, the skirt portion 115 may also be formed with an internal frame and the Anti-Ballistic panel may be formed by wrapping high strength synthetic fibers such as aramid around the frame in at least two different directions. Additionally, padding may be provided between the Anti-Ballistic panel and a covering surrounding skirt panel 115.

In an alternate embodiment, the Anti-Ballistic panel may be independent from the core of the back panel 105. In this embodiment, the back panel 105 may be formed with a pocket or pouch that can receive Anti-Ballistic panel between the core and the cover of the back panel 105 and hold the Anti-Ballistic panel substantially parallel to the core. In such an embodiment, a slot or opening may be provided in the covering to allow insertion and removal of such an Anti-Ballistic panel, such as the slot 160. The Anti-Ballistic panel may be inserted into the pouch or pocket by being inserted into the slot or opening 160 in a portion of the back panel. The specific configuration of the pouch or pocket and the placement of the opening are not particularly limited as should be apparent to a person of ordinary skill in the art. Further, the seat portions 110, and skirt portions 115 may be formed with constructions similar to the back panel 105.

Further, in this embodiment, a storage compartment 130 is disposed beneath the seat member 110 and is configured to be accessible by the chair user. Specifically, the storage compartment 130 may be designed to hold a fire arm, such as a small semi-automatic pistol or revolver. Thus, in the event of a shooting, the user can draw the fire arm and return fire while still using the Anti-Ballistic panels of the chair to provide shielding. The compartment 130 may be accessible from either a side of the chair 100, or may be accessible from the front or rear of the chair 100, or some combination of the sides, front or rear. Further, the storage compartment 130 may also include a locking mechanism 165 next to the storage compartment. The locking mechanism 165 may be designed to hold the storage compartment 130 in a locked position until an authorized user open the compartment. In some embodiments, the locking mechanism 165 may be a push button lock requiring the user push a combination of buttons in sequence, or simultaneously to allow the compartment 130 to be opened and the fire arm accessed. Alternatively, in some embodiments, the locking mechanism 165 may be a biometric lock requiring verification of biometric information of the user to open the compartment 130. For example, a finger print, retinal scan, or other piece of biometric information may be used to open release the locking mechanism 150 and allow the compartment 130 to be opened.

Sometimes, the chair may be used in a situation where the user first hides or takes shelter behind the back portion 105, seat portion 110, and skirt portion 115 and then returns fire. Therefore, the compartment 130 for the firearm may be located in a place which a person hiding from fire behind the chair 100 is able to reach the firearm without exposing any part of his/her body to the fire. In such a situation, the person hiding behind the chair 100 has to move their left had out of the safe position in order to access a storage compartment 130 located under the seat portion 110 or in the arm rest 125. Thus, the storage compartment 130 may also be placed in the skirt portion 115 or in the seating portion 110, which may be reachable from the safe position behind the chair.

As illustrated, the Anti-Ballistic chair 100 also includes a swivel mechanism 135 connecting the seat member 110 to a wheel portion 140. The swivel mechanism 135 may include a low friction bearing 135 to allow the chair 100 to be quickly rotated around a full 360° range of motion with minimal resistance so that a user can quickly turn the Anti-Ballistic portion toward a threat. Further, the wheel portion 140 includes a plurality of wheels at the end of a support base designed to support the chair and allow it to be quickly rolled about for mobile shield protection.

Figure 4B:
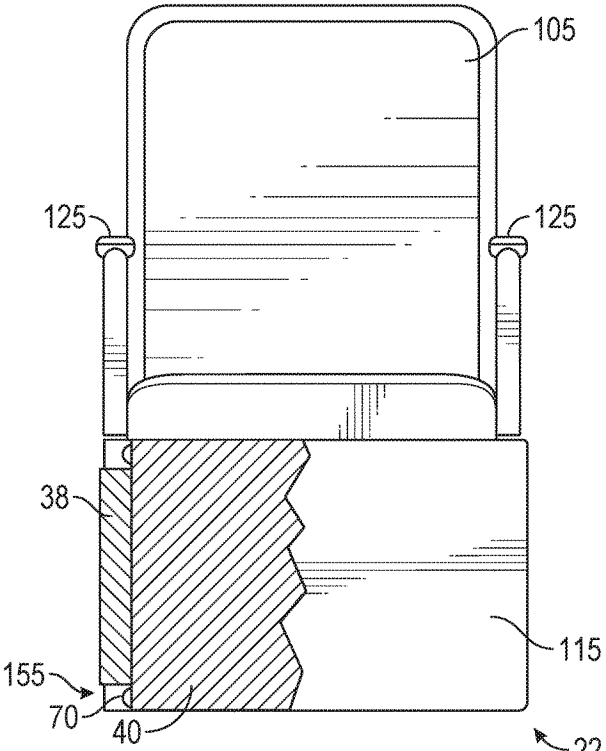
FIGS. 4*a* and 4*b* depicts partial cut away views of the back panel and skirt panel respectively constructed in accordance an embodiment of the present application.
Figure 4A:
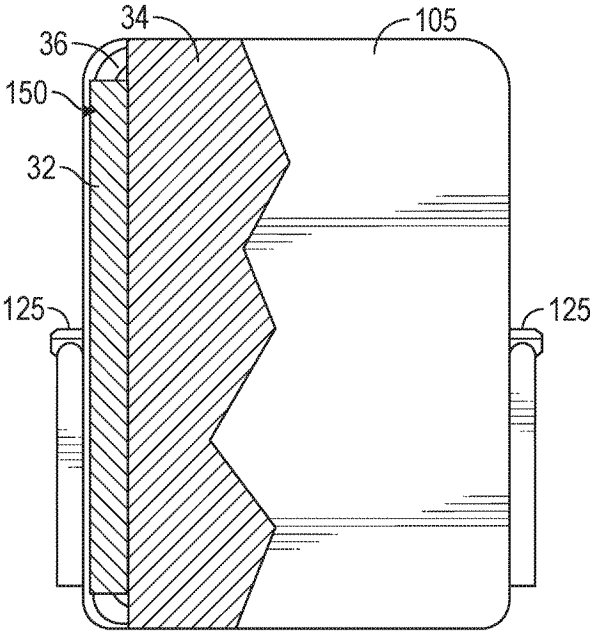

FIG. 4*a* depicts a rear view of the Anti-Ballistic Chair 100 with the back portion 105 having a portion of the decorative outer covering and cushioning material removed exposing the Anti-Ballistic panel 150 that is disposed within the back portion 105. As illustrated, the Anti-Ballistic panel 150 is formed with a tubular metal frame 36 with aramid fiber protective material wrapped around the frame in at least two different directions. For example, in this embodiment, aramid fiber protective material is wrapped around the frame 36 in a horizontal direction the horizontal layers 32 of the aramid fiber protective material. Further, the aramid fiber protective material is also wrapped around the frame 36 in a vertical direction to form the vertical layers 34 of the aramid fiber protective material. As illustrated the horizontal layers 32 and vertical layers 34 cross at a substantially 90° angles, but embodiments of this application need not have the layers 32, 34 cross at substantially 90° angles, but could instead cross at angles less than or greater than 90°.

In some embodiments, the frame 36 of the Anti-Ballistic panel 150 may also be the support frame of the back portion 105. In other embodiments, the frame 36 of the Anti-Ballistic panel 150 may be a separate panel independent from the support frame of the back portion 105.

FIG. 4*b* depicts a front view of the Anti-Ballistic Chair 100 having a portion of the conventional decorative outer covering and cushioning material removed from the from skirt portion 115 exposing the Anti-Ballistic panel 155 disposed within the skirt portion 115. As illustrated, the Anti-Ballistic panel 155 includes a tubular metal frame 70 with aramid fiber protective material wrapped around the frame in at least two different directions. For example, in this embodiment, aramid fiber protective material is wrapped around the frame 70 in a horizontal direction the horizontal layers 38 of the aramid fiber protective material. Further, the aramid fiber protective material is also wrapped around the frame 70 in a vertical direction to form the vertical layers 40 of the aramid fiber protective material. As illustrated the horizontal layers 38 and vertical layers 40 cross at a substantially 90° angles, but embodiments of this application need not have the layers 38, 40 cross at substantially 90° angles, but could instead cross at angles less than or greater than 90°.

In some embodiments, the frame 70 of the Anti-Ballistic panel 155 may also be the support frame of the skirt portion 115. In other embodiments, the frame 52 of the Anti-Ballistic panel 150 may be a separate panel independent from the support frame of the back skirt portion 115. Additionally, the seat portion of the Anti-Ballistic chair 100 may be made in a similar fashion with additional padding for comfort.

It must be fully understood at this time that different Anti-Ballistic materials can be used for the purpose of constructing the Anti-Ballistic Chair 100 including a variety of soft materials along with hard surfaced resin impregnated laminated Anti-Ballistic materials some of which are sold by Du Pont under the registered trademark KEVLAR® and will still remain within the scope of this application.

Additionally, the Anti-Ballistic portions of the Anti-Ballistic chairs may be fabricated using not only aramid fibers and KEVLAR® from DuPont, but also polyethylene fibers and GOLD SHIELD®, which is a KEVLAR® based material, and SPECTRA SHIELD®, which is polyethylene based material, both available commercially from Honeywell. GOLD SHIELD® and SPECTRA SHIELD® are high strength synthetic fibers impregnated in partially cured resin for use in ballistic material.

Moreover, both of the Honeywell materials can be used as layered soft armor as well as hard armor when they are autoclaved or compression molded into Anti-Ballistic components for construction of the Anti-Ballistic chairs, as shown and described. Other similar materials of like purpose and function are also anticipated by this disclosure.

Figure 5:
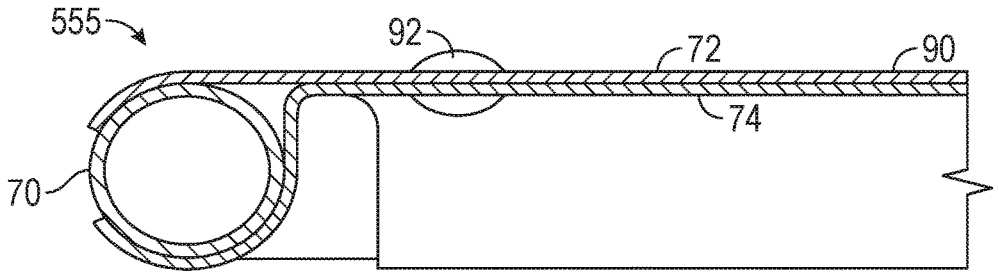
FIG. 5 depicts a cross section through a segment of an Anti-Ballistic Panel illustrating two rigid members attached together over a tubular framework of the panel in accordance with an embodiment of the present application.

FIG. 5 depicts a cross section through a segment of the frame 70 of an alternative embodiment of an Anti-Ballistic panel 555 that could be incorporated into any one of the back portion 105, seat portion 110, or skirt portion 115. As illustrated, the Anti-Ballistic panel 555 is configured to be incorporated into the seat portion 110. In this embodiment, the Anti-Ballistic panel 555 includes a upper rigid aramid panel 72 and a lower rigid aramid panel 74 attached together by the means of conventional fasteners (such as screws, nails, bolts, rivets, etc.) 92 and a bonding agent 90 (such as adhesive, epoxy, glue, etc.) over the tubular frame 70 of the anti-ballistic panel 555. Each of these rigid panels 72, 74 is formed from aramid fibers and the upper rigid panel 72 is oriented so that the fibers run in a first direction and the lower rigid panel 74 is oriented so that fibers run in a second direction, different from the first direction. Similar Anti-Ballistic panels could be incorporated into the back portion 105 or skirt portion 115. Alternatively, the Anti-Ballistic panel may incorporated as part of the core of any one of the back portion 105, seat portion 110, and/or skirt portion 115 as shown, for example in FIG. 6 below.

Figure 6:
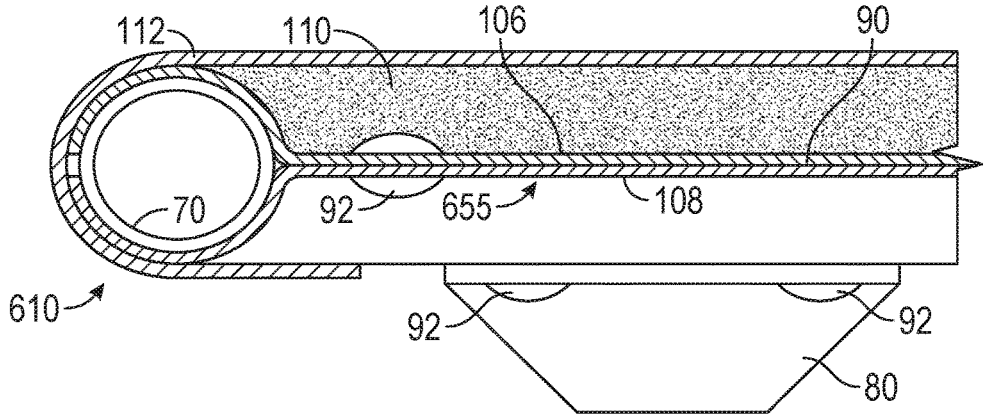
FIG. 6 depicts a cross section through a segment of an Anti-Ballistic Panel illustrating the two rigid aramid members attached together centrally located in the tubular frame work with a foam cushion and decorative fabric covering attached to the panel in accordance with an embodiment of the present application.

FIG. 6 depicts a cross section of through a segment of the frame 70 of the Anti-Ballistic panel 655 incorporated in to the core of a seat portion 610. In this embodiment, 655 includes an upper rigid aramid panel 106 and a lower rigid aramid panel 108 attached together by the means of conventional fasteners (such as screws, nails, bolts, rivets, etc.) 92 and a bonding agent 90 (such as adhesive, epoxy, glue, etc.) over the tubular frame 70 of the Anti-Ballistic panel 655. Each of these rigid panels 106, 108 is formed from aramid fibers and the upper rigid panel 106 is oriented so that the fibers run in a first direction and the lower rigid panel 108 is oriented so that fibers run in a second direction, different from the first direction. Additionally, in this embodiment, decorative fabric covering 112 is provided over the seat portion 610 and a foam cushion 110 is provided between the fabric covering 112 and the Anti-Ballistic panel 655. A bracket 80 may also be connected to the seat portion 610 by fasteners 92. The bracket 80 may connect the seat portion 610 to a lower pivot mechanism (not shown). The back portion 105 and/or skirt portion 115 may have similar constructions to the seat portion 610 in similar embodiments.

Figure 7:
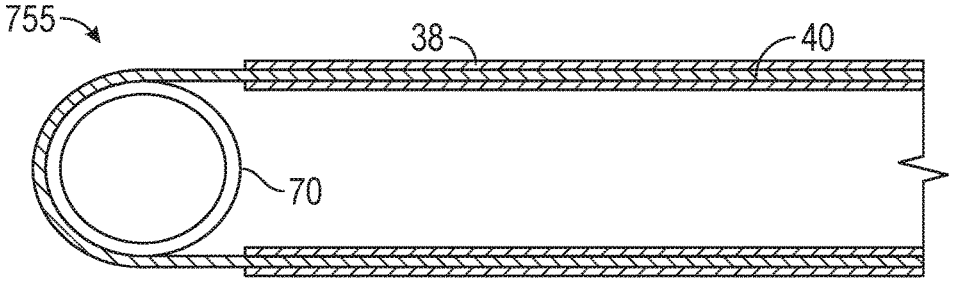
FIG. 7 depicts a cross section through a segment of an Anti-Ballistic panel illustrating two sheets of flexible fabric woven from the aramid fiber wrapped around the frame of the panel constructed in accordance with an embodiment of the present application.

FIG. 7 depicts a cross section through a segment of an Anti-Ballistic panel 755 that could be incorporated into any one of the back portion 105, seat portion 110, or skirt portion 115. As illustrated, the Anti-Ballistic panel 755 is configured to be incorporated into the seat portion 110. In this embodiment, the Anti-Ballistic panel 755 includes a first sheet 38 of aramid fibers wrapped around the frame 70 in a first direction and a second sheet 40 of aramid fibers wrapped around the frame 70 in a second direction. Similar Anti-Ballistic panels could be incorporated into the back portion 105 or skirt portion 115. Alternatively, the Anti-Ballistic panel may incorporated as part of the core of any one of the back portion 105, seat portion 110, and/or skirt portion 115 as shown, for example in FIG. 6 above.

Again, as previously described, the Anti-Ballistic portions of the Anti-Ballistic panels may be fabricated using not only aramid fibers and KEVLAR® from DuPont, but also polyethylene fibers and GOLD SHIELD,® which is a KEVLAR® based material, and SPECTRA SHIELD,® which is polyethylene based material both available commercially from Honeywell. GOLD SHIELD® and SPECTRA SHIELD® are high strength synthetic fibers impregnated in partially cured resin for use in ballistic material. Moreover, both of the Honeywell materials can be used as layered soft and/or as well as hard armor when they are autoclaved or compression molded into Anti-Ballistic components for construction of the Anti-Ballistic folding chairs, as shown and described. Other similar materials of like purpose and function are also anticipated by this disclosure. Additionally, in some embodiments an Anti-Ballistic panel in the rear portion may be a hard armor panel and an Anti-Ballistic panel in the seat portion or the skirt portion may be a soft armor panel. Conversely, an Anti-Ballistic panel in the seat portion or the skirt portion may be a hard armor panel and the Anti-Ballistic in the rear portion may be a soft armor panel, or any other combination as may be apparent to a person of ordinary skill in the art.

The Anti-Ballistic Chairs and components shown in the drawings and described in detail herein disclose arrangements of elements of particular construction and configuration for illustrating embodiments of structure and method of operation of the present application. It is to be understood, however, that elements of different construction and configuration and other arrangements Anti-Ballistic Chairs in accordance with the spirit of this thereof other than those illustrated and described may be employed for providing disclosure, and such changes, alternations and modifications as would occur to those skilled in the art are considered to be within the scope of this design as broadly defined in the appended claims.

The abstract and any summaries provided herein are not intended to limit the scope of the present application, which is measured by the claims.

We claim:

1. An Anti-Ballistic chair comprising:

a back portion;

a seat portion;

a skirt portion hingedly connected to the seat portion and configured to be moved between an extended portion extending downward from the seat portion and a folded position substantially parallel to the seat portion; and a first Anti-Ballistic panel removably inserted into a pocket having an opening formed within at least one of the back portion, the seat portion, and the skirt portion, wherein the Anti-Ballistic panel comprises at least a first layer of Anti-Ballistic material formed from high-strength synthetic fibers extending in a first direction, and at least a second layer of Anti-Ballistic material formed from high-strength synthetic fibers extending in a second direction, different from the first direction.

2. The Anti-Ballistic chair according to claim 1, wherein the seat portion comprises a frame, wherein the first Anti-Ballistic panel comprises the frame of the seat portion, at least the first layer of high-strength synthetic fibers wrapped around the frame in the first direction, and at least the second layer of high-strength synthetic fibers wrapped around the frame in the second direction, different from the first direction.

3. The Anti-Ballistic chair according to claim 2, further comprising a second Anti-Ballistic panel disposed within the back portion.

4. The Anti-Ballistic chair according to claim 3, wherein the back portion comprises a back frame, wherein the second Anti-Ballistic panel comprises the back frame of the seat portion, at least a first layer of high-strength synthetic fibers wrapped around the back frame in a first direction, and at least a second layer of high-strength synthetic fibers wrapped around the frame in a second direction, different from the first direction.

5. The Anti-Ballistic chair according to claim 3, wherein the back portion comprises the pocket having the opening; and wherein the first Anti-Ballistic panel is disposed removably inserted into the pocket in the back portion.

6. The Anti-Ballistic chair according to claim 3, wherein the first Anti-Ballistic panel is a Hard Armor panel.

7. The Anti-Ballistic chair according to claim 1, further comprising a storage compartment disposed in at least one of the seat portion, skirt portion and back portion, the storage compartment being shaped and sized to hold a firearm.

8. The Anti-Ballistic chair according to claim 7, wherein the storage compartment is disposed on a bottom portion of the seat portion.

9. The Anti-Ballistic chair according to claim 7, further comprising a locking mechanism configured to secure the storage compartment in a lock configuration.

10. The Anti-Ballistic chair according to claim 9, wherein the locking mechanism is at least one of a combination lock, a push button lock, and a biometric lock.

11. An Anti-Ballistic chair comprising:

a back portion;

a seat portion; and a first Anti-Ballistic panel removably inserted into a pocket having an opening formed within at least one of the back portion, and the seat portion, wherein the Anti-Ballistic panel comprises at least a first layer of Anti-Ballistic material formed from high-strength synthetic fibers extending in a first direction, and at least a second layer of Anti-Ballistic material formed from high-strength synthetic fibers extending in a second direction, different from the first direction.

12. The Anti-Ballistic chair according to claim 11, wherein the seat portion comprises a frame, wherein the first Anti-Ballistic panel comprises the frame of the seat portion, at least the first layer of high-strength synthetic fibers wrapped around the frame in the first direction, and at least the second layer of high-strength synthetic fibers wrapped around the frame in the second direction, different from the first direction.

13. The Anti-Ballistic chair according to claim 12, further comprising a second Anti-Ballistic panel disposed within the back portion.

14. The Anti-Ballistic chair according to claim 13, wherein the back portion comprises a back frame, wherein the second Anti-Ballistic panel comprises the back frame of the seat portion, at least a first layer of high-strength synthetic fibers wrapped around the back frame in a first direction, and at least a second layer of high-strength synthetic fibers wrapped around the frame in a second direction, different from the first direction.

15. The Anti-Ballistic chair according to claim 13, wherein the back portion comprises the pocket having the opening; and wherein the first Anti-Ballistic panel is disposed removably inserted into the pocket in the back portion.

16. The Anti-Ballistic chair according to claim 13, wherein the first Anti-Ballistic panel is a Hard Armor panel.

17. The Anti-Ballistic chair according to claim 11, further comprising a storage compartment disposed in at least one of the seat portion, skirt portion and back portion, the storage compartment being shaped and sized to hold a firearm.

18. The Anti-Ballistic chair according to claim 17, wherein the storage compartment is disposed on a bottom portion of the seat portion.

19. The Anti-Ballistic chair according to claim 17, further comprising a locking mechanism configured to secure the storage compartment in a lock configuration.

20. The Anti-Ballistic chair according to claim 19, wherein the locking mechanism is at least one of a combination lock, a push button lock, and a biometric lock.

* * * * *